US007437839B2

(12) United States Patent
Christy et al.

(10) Patent No.: US 7,437,839 B2
(45) Date of Patent: Oct. 21, 2008

(54) CUTTING EDGE FOR A V-BLADE SNOWPLOW

(75) Inventors: Jody M. Christy, Iron Mountain, MI (US); Chris M. Kuzak, Channing, MI (US); Tristan W. Summers, Iron Mountain, MI (US); Mike K. Nylund, Iron Mountain, MI (US); Steve Grunlund, Iron Mountain, MI (US)

(73) Assignee: Northern Star Industries, Inc., Iron Mountain, MI (US)

( * ) Notice: Subject to any disclaimer, the term of this patent is extended or adjusted under 35 U.S.C. 154(b) by 86 days.

(21) Appl. No.: 11/002,332

(22) Filed: Nov. 30, 2004

(65) Prior Publication Data

US 2006/0123669 A1 Jun. 15, 2006

(51) Int. Cl.
*E01H 5/06* (2006.01)

(52) U.S. Cl. ..... 37/273; 37/232; 37/283

(58) Field of Classification Search ..... 37/232, 37/233, 264, 266, 269, 272, 273, 283, 284; 172/817

See application file for complete search history.

(56) References Cited

U.S. PATENT DOCUMENTS

| | | | | | |
|---|---|---|---|---|---|
| 79,606 | A | * | 7/1868 | Smith | 37/210 |
| 222,036 | A | * | 11/1879 | Graff | 104/279 |
| 1,621,040 | A | * | 3/1927 | Thompson | 37/272 |
| 1,997,001 | A | * | 4/1935 | Lamb | 172/815 |
| 2,229,053 | A | * | 1/1941 | De Vaux | 37/273 |
| 2,428,131 | A | * | 9/1947 | Uebelhoer | 37/273 |
| 2,468,950 | A | * | 5/1949 | Wiedman | 37/231 |
| 2,590,143 | A | * | 3/1952 | Adams, Jr. et al. | 37/273 |
| 2,904,904 | A | * | 9/1959 | Krueger | 37/275 |
| 3,157,099 | A | * | 11/1964 | Ulrich | 172/815 |
| 3,378,084 | A | * | 4/1968 | Ulrich | 172/247 |
| 3,512,589 | A | * | 5/1970 | Ulrich | 172/786 |
| 3,526,979 | A | * | 9/1970 | Ladewski | 37/273 |
| 3,533,175 | A | * | 10/1970 | Snyder | 37/273 |
| 3,803,733 | A | * | 4/1974 | Ramsey | 37/273 |
| 3,898,753 | A | * | 8/1975 | Kinnunen | 37/273 |
| 4,074,448 | A | * | 2/1978 | Niemela | 37/234 |

(Continued)

FOREIGN PATENT DOCUMENTS

| | | | |
|---|---|---|---|
| JP | 2-311607 | * | 12/1990 |

OTHER PUBLICATIONS

Assembly Instruction sheets for The Boss Snowplow Snow Catcher Kit, published prior to 2003.

*Primary Examiner*—Thomas A Beach
(74) *Attorney, Agent, or Firm*—Quarles & Brady; George E. Haas

(57) ABSTRACT

A V-blade plow has adjustable first and second blades, each with an inner end that is rotatably connected to a pivot frame. The plow is provided with a cutting edge arrangement comprising first and second edge segments and a center edge segment there between. The first edge segment is removably attached to the first plow blade and projects downward below the bottom edge of the first plow blade. The second edge segment is removably attached to the second plow blade projecting below the bottom edge of the second plow blade. The center edge segment is mounted beneath the pivot frame and is attached to the first and second plow blades to prevent the material being plowed from passing beneath the pivot frame between the blades.

18 Claims, 2 Drawing Sheets

U.S. PATENT DOCUMENTS 4,135,583 A * 1/1979 Becker ..... 172/815
4,159,584 A * 7/1979 Niemela ..... 37/241
4,346,928 A * 8/1982 Towsend ..... 294/51
4,384,620 A * 5/1983 Uchida et al. ..... 172/815
4,597,202 A * 7/1986 Weeks ..... 37/232
4,899,472 A * 2/1990 Winter ..... 37/270
6,108,946 A 8/2000 Christy
6,240,658 B1 * 6/2001 Knutson et al. ..... 37/231
6,412,199 B1 * 7/2002 Quenzi et al. ..... 37/281
6,813,848 B2 * 11/2004 Ortamala ..... 37/222

* cited by examiner

FIG. 1
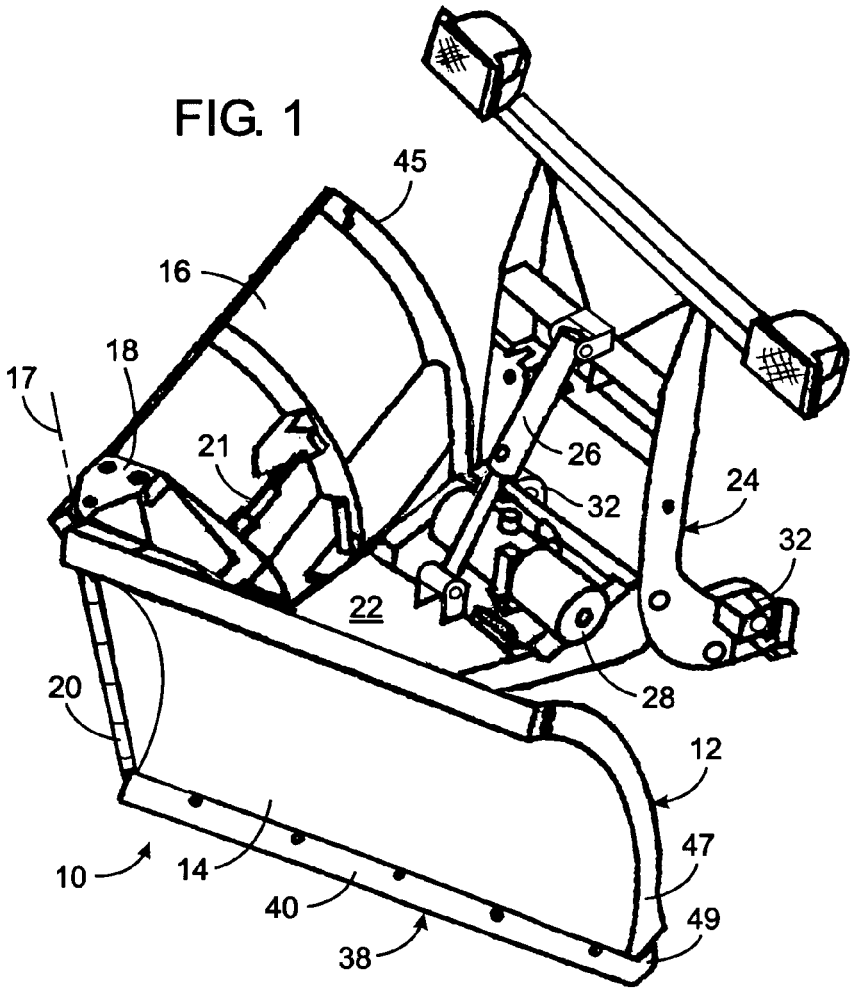
FIG. 2
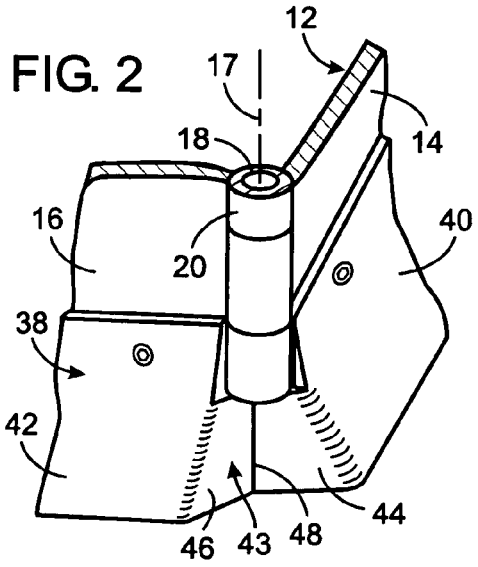
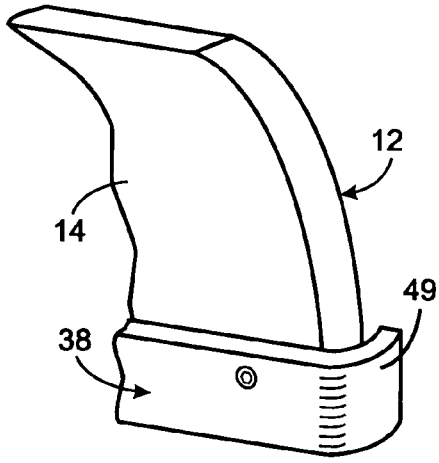
FIG. 3

FIG. 4
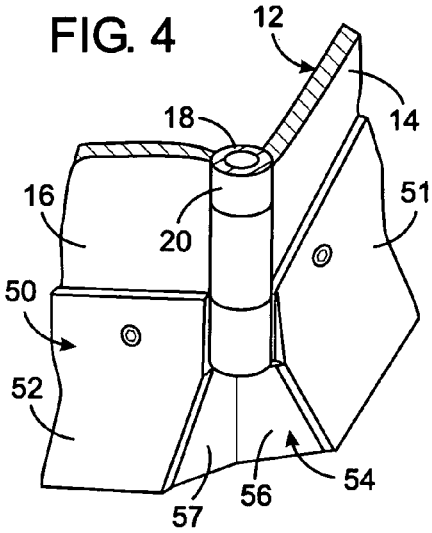
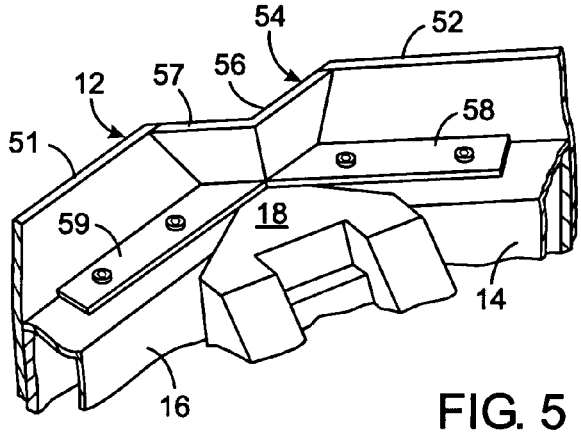
FIG. 5
FIG. 6
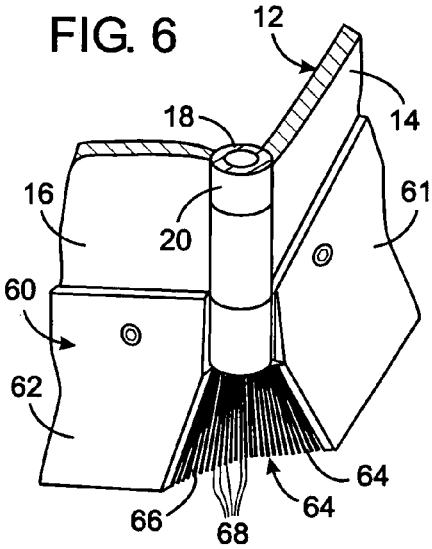
FIG. 7
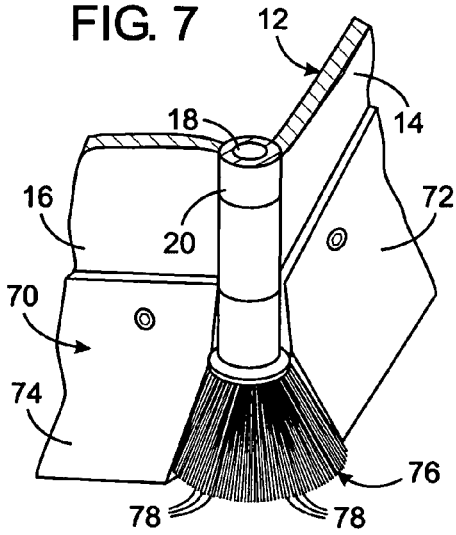

CUTTING EDGE FOR A V-BLADE SNOWPLOW

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

The present invention relates to V-blade snowplows, and more particularly to replaceable cutting edges of such plows.

2. Description of the Related Art

The most common type of snowplow has a straight blade which mounted to and extends across the full width of the front of a vehicle, such as a truck. In the simplest form, the angle of the blade with respect to the front of the vehicle is fixed at an angle so that snow being pushed by the blow is forced to one side. A more versatile straight plow enables blade to pivot with respect to the front of the vehicle so that the snow can be pushed to either side or straight ahead.

Another type of snowplow utilizes a V-blade which has two angled sections that meet at a forward edge and push the snow to both sides of the vehicle. This type of plow can incorporate a mechanism to alter the angle of the blades with respect to the each other. Typically, each blade is hinged to a center section of the plow frame and separate double-acting hydraulic cylinder and piston arrangements pivot the blade about the vertical hinge. This enables the two sections of the blade to be positioned in a standard "V" configuration that pushes the snow to each side, in a concave or scoop arrangement, or in a straight line that can be angled to either side of the vehicle.

In use, the bottom, or cutting, edge, of the blade scrapes against the surface being plowed. Usually that surface is very hard, often asphalt or concrete, which wears away the cutting edge. As a consequence the typical blade has a sacrificial cutting edge in the form of a metal plate that is removably mounted along the bottom edge. The edge plate, rather than the main section of the blade, is subjected to the wear during use. When most of the cutting edge plate has worn away it is replaced with a new one. It is more economical to replace the sacrificial cutting edge plate than the entire blade.

A characteristic of a V-blade is that the two blades are spaced apart under the center frame section which creates a gap through which some of the material being plowed can pass. This could leave in a rib of snow down the center of the area being plowed. To prevent this from occurring, prior blades spanned the gap with a flat rubber belt that was bolted to the cutting edges of each blade extending in front of the hinge on the center section. This belt flexed and stretched as the angle of the two blades changed. U.S. Pat. No. 6,108,946 describes an alternative solution that employs a semi-conical, solid catcher block beneath the center section of the V-blades. The catcher block closed the gap between the blade and its conical shape allowed the two sections to pivot without opening a gap. However the semi-conical catcher wore at a different rate than the cutting edges and had to be replaced at a different time. Furthermore, the solid block of material did not yield when struck by an object, such as a stone or other type of protrusion from the surface being plowed.

The outer tips of the blade also are subject to wear when plowing against a curb. In addition, significant force may be exerted on the edge of the blade upon striking a curb, which can adversely affect the blade hinge and the cylinder-piston arrangement used to pivot the blades. These forces, if significant, also can damage other components of the snowplow.

SUMMARY OF THE INVENTION

A V-blade plow has adjustable first and second blades, each with a bottom edge and an inner end that is rotatably connected to a pivot frame. The plow is provided with a cutting edge arrangement comprising first and second edge segments and a center edge segment there between. The first edge segment is removably attached to the first plow blade and projects downward below the bottom edge of the first plow blade. The second edge segment is removably attached to the second plow blade projecting below the bottom edge of the second plow blade. The center edge segment is mounted beneath the pivot frame and is attached to the first and second plow blades.

In a preferred embodiment of the cutting edge arrangement, the center edge segment is formed by a first wall that extends from the first edge segment under the pivot frame and by a second wall that extends from the second edge segment. The first and second walls meet beneath the pivot frame. The first wall may be integral with the first edge segment and the second wall may be integral with the second edge segment with a break between them. Alternatively, the first and second walls can be a single flexible piece of material attached to both the first and second edge segments. In yet another embodiment, the two walls are formed by a plurality of bristles, thereby creating an angled brush below the pivot frame.

BRIEF DESCRIPTION OF THE DRAWINGS

FIG. 1 is an isometric view of a V-blade snowplow incorporating the present invention;

FIG. 2 is an isometric rendering of the lower part of the pivot frame of the snowplow blades illustrating the novel edge guard;

FIG. 3 depicts an outer end of the snowplow blade;

FIG. 4 is an isometric view of the lower portion of the pivot frame of the snowplow blades showing a second embodiment of an cutting edge according to the present invention;

FIG. 5 is an isometric representation of the underside of the pivot frame of the plow blade assembly in FIG. 4;

FIG. 6 is an isometric view of the lower portion of the pivot frame of the snowplow blade showing a third embodiment of a cutting edge; and FIG. 7 is an isometric view of a fourth embodiment of a cutting edge.

DETAILED DESCRIPTION OF THE INVENTION

Although the present invention is being described in the context of a snowplow, the inventive concepts can be applied to V-blade plows for pushing other materials, such as earth, gravel and the like.

With initial reference to FIG. 1, a snowplow 10 comprises a blade assembly 12 that has a first, or left, blade 14 and a second, or right, blade 16 moveably joined at their inner ends to a pivot frame 18 by a shared hinge 20. Both blades 14 and 16 is able to pivot about the hinge axis 17 so that the blade assembly 12 can have a V configuration, as illustrated, or an inverse V in which the outer ends of each blade project forward of the pivot frame 18 to form a concave blade, or scoop. Alternatively, the first and second blades 14 and 16 can be aligned as a straight blade that can be rotated left or right about the pivot frame 18. A hydraulic cylinder and piston assembly 21 is coupled between the pivot frame 18 and the second blade 16 to rotate that blade about the hinge 20. Although not visible in the drawings, another hydraulic cylinder and piston assembly is coupled between the pivot frame 18 and the first blade 14 to provide pivoting motion there between.

The pivot frame 18 is secured to a push frame 22 which extends in a generally horizontal rearward direction from the bottom portion of the pivot frame. The end of the push frame 22 that is remote from the blade assembly 12 is coupled to a vehicle mount 24 in a manner that allows the push frame 22 to pivot about a horizontal axis. That pivot connection permits the push frame and blade assembly 12 to be raised and lowered with respect to the ground. A lift cylinder and piston assembly 26 extends between the push frame 22 and the vehicle mount 24 for that movement.

A hydraulic pump and motor 28 and a conventional hydraulic fluid reservoir are mounted on the push frame 22. The motor of the pump is powered by electricity from the vehicle to which the snowplow is attached. Separate electrically operated control valves and hoses couple the pump and motor 28 to the different hydraulic cylinder and piston assemblies 21 and 26 in a conventional manner. A standard control panel is provided within the cab of the vehicle and has switches that enable the driver to independently operate each of the cylinders to pivot the first and second blades 14 and 16 and raise and lower the entire blade assembly 12.

The vehicle mount 24 has couplings 30 and 32 on opposite sides for detachably engaging a support that is secured to the frame of the vehicle. Any of several well known mounting mechanisms can be provided for this purpose.

A cutting edge 38 is mounted along the lower regions of the front surface of the first and second blades 14 and 16 projecting below the bottom edge of the blades. The cutting edge 38 can be made of a rigid material, such as metal or a hard plastic, or a flexible material, such as polyurethane, plastic or a relatively hard rubber. With additional reference to FIG. 2, the cutting edge 38 has an elongated first segment 40 that is bolted or otherwise attached to the lower region of the first blade 14 and an elongated second segment 42 is bolted to the lower region of the second blade 16. The cutting edge 38 further includes a center segment 43 underneath the pivot frame 18 and formed by two center walls 44 and 46. Specifically, the first segment 40 bends inwardly into the first center wall 44 that extends under the pivot frame 18, and the second segment 42 bends inward forming the second center wall 46 which also projects under the pivot frame. The bend at the interface between the elongated segment 40 or 42 and the associated center wall 44 or 46 provides a smooth contour to the material being pushed by the plow. If a semi-rigid, yet flexible material is used, the center walls 44 and 46 are able to flex and allow an obstruction to pass under the pivot frame 18. The interior remote ends of the two center walls 44 and 46 meet in an abutting manner at an interior vertical seam 48 that is aligned with the axis of the hinge 20. Therefore, as the first and second blades 14 and 16 rotate about the hinge 20 the interior remote ends of the first and second center walls 44 and 46 remain abutting so that a gap is not created through which the material being plowed may pass.

By using a flexible material, the entire cutting edge 38 alternatively can be formed as a single piece. In this case, the first and second center walls 44 and 46 are joined at the seam 48 with the material providing a flexible joint between those walls which bends as the blades rotate about the hinge 20.

The entire cutting edge 38 wears at the same rate, and thus, does not employ separate pieces of various sizes and materials which wear at different rates and may have to be replaced at different times.

With reference to FIG. 3, the cutting edge 38 also protects the outside end of each blade 14 and 16 from damage due to striking a curb or other object extending upward from the surface being plowed. Specifically, the cutting edge 38 extends past the outer end 47 of the first blade 14, curving into a rearwardly projecting side section 49 that is spaced from the vertical end. Thus, the side section 49 will rub against a curb and preventing wear from occurring on the outer end 47 of the first blade 14 on the left side of the snowplow 10. Also, the flexible nature of the cutting edge 38, enables this side section 49 to absorb some of the impact force resulting from striking a curb or other object and does not transfer that force through the first blade 14 into other components of the snowplow 10. It should be noted that the outside edge 45 of the second blade 16 is similarly protected by the wrap-around end segment of the cutting edge 38.

FIGS. 4 and 5 depict a second embodiment of a snowplow cutting edge 50 that comprises three separate pieces: elongated first and second segments 51 and 52 and a V-shaped center segment 54. One of the first and second segments 51 or 52 is bolted or otherwise attached to the bottom portion of one of the two blades 14 and 16 in much the same manner as conventional cutting edges attached to existing blades. The V-shaped center edge segment 54 comprises a pair of walls 56 and 57 projecting at an angle from one another and terminating at a tapered edge that abuts the inside surface of two elongated edge segments 51 and 52. That abutting relationship inhibits the material being plowed from passing between hose elongated sections. Preferably the walls 56 and 57 are formed by a single piece of material, such as polyurethane, plastic or a relatively hard rubber, but could be separate pieces in which case they could also be made of metal. The separate elongated first and second segments 51 and 52 may be made of the same material or metal. However, all the pieces of the cutting edge 50 will wear at the same rate if they are all made of the same material.

With specific reference to FIG. 5, the center edge segment 54 has a mounting bracket 58 or 59 extending from the inside surfaces of the each wall 56 or 57, respectively. The mounting brackets 58 and 59 are attached by machine screws or other fasteners to the bottom edges of the first and second blades 14 and 16, respectively, thereby securing the center edge segment 54 beneath the pivot frame 18 of the snowplow blade assembly 12. The two walls 56 and 57 the center edge segment 54 is made of a single piece of material that is formed at an angle. This material is flexible so that the pivot frame can bend at the interface between the two walls when one or both of the two blades 14 and 16 pivots about the hinge 20.

With reference to FIG. 6 a variation of a three-piece cutting edge 60 has individual, elongated first and second segments 61 or 62 attached to the bottom portion of the two blades 14 and 16. A separate V-shaped center edge segment 64 comprises has a pair of angled walls 65 and 66 located beneath the pivot frame 18 in an orientation identical to that of walls 56 and 57 in FIGS. 4 and 5. However, walls 65 and 66 are each formed by a linear array of relatively stiff bristles 68, thus forming a brush beneath the pivot frame 18. That brush may comprises several rows of bristles 68 one behind the other. Each bristle 68 may be a thin rod or ribbon of stiff plastic material, for example. The upper ends of the bristles are mounted in a bracket that is attached to the blades 14 and 16 in the same manner as the walls 56 and 57 of the center edge segment 54 in FIG. 5.

Referring to FIG. 7, another version of a cutting edge 70 according to the present invention, utilizes separate elongated first and second segments 72 and 74 that are bolted or otherwise attached to the bottom portions of the first and second blades 14 and 16 respectively. A center cutting edge segment in the form of a conical brush 76 is mounted beneath the pivot frame 18 of the blade assembly 12. The conical brush 76 comprises a plurality of relatively stiff bristles 78 extending at an angle that projects outward from the pivot frame 18 to form the conical shape. Each bristle may comprise a thin rod or ribbon of stiff plastic material, for example. The brush may comprise a single circular array of bristles, or several concentric arrays, depending upon the stiffness of the bristles in resisting the material being plowed from passing between the two blades 14 and 16. The conical brush 76 has increased durability and resistance to impact with obstructions as compared to a solid center edge.

The foregoing description was primarily directed to a preferred embodiment of the invention. Although some attention was given to various alternatives within the scope of the invention, it is anticipated that one skilled in the art will likely realize additional alternatives that are now apparent from disclosure of embodiments of the invention. Accordingly, the scope of the invention should be determined from the following claims and not limited by the above disclosure.

The invention claimed is:

1. In a V-blade plow with adjustable first and second plow blades, each having an inner end rotatably connected to a pivot frame to pivot about an axis, and having a bottom edge, a cutting edge arrangement comprising:

a first edge segment removably attached to the first plow blade and projecting downward below the bottom edge of the first plow blade;

a second edge segment removably attached to the second plow blade and projecting downward below the bottom edge of the second plow blade; and a center edge segment comprising a first wall and a second wall, wherein the first wall is attached to the first edge segment, pivots with the first plow blade about the axis, and extends from the first edge segment underneath the pivot frame, and wherein the second wall is attached to the second edge segment, pivots with the second plow blade about the axis, and extends from the second edge segment underneath the pivot frame, wherein first wall abuts the second wall along the axis.

2. The cutting edge arrangement as recited in claim 1 wherein the first edge segment, the second edge segment, and the center edge segment are a single piece.

3. The cutting edge arrangement as recited in claim 1 wherein the first wall is integral with the second wall.

4. The cutting edge arrangement as recited in claim 1 wherein the first wall is detached from the second wall.

5. The cutting edge arrangement as recited in claim 1 wherein the first wall is mounted on the first blade and the second wall is mounted on the second blade.

6. The cutting edge arrangement as recited in claim 1 wherein the first wall and the second wall are each formed by a plurality of bristles.

7. The cutting edge arrangement as recited in claim 6 wherein the bristles are made of a plastic.

8. The cutting edge arrangement as recited in claim 1 wherein the center edge segment is formed by a plurality of bristles projecting downward from below the pivot frame.

9. The cutting edge arrangement as recited in claim 1 wherein the first wall and the second wall are each formed of a material selected from the group consisting of metal, polyurethane, plastic, and rubber.

10. The cutting edge arrangement as recited in claim 1 wherein the first edge segment has a side section projecting around an outer end of the first plow blade.

11. The cutting edge arrangement as recited in claim 1 wherein the center edge segment is attached directly to each of the first and second plow blades.

12. The cutting edge arrangement as recited in claim 1 wherein first wall is integral with the first edge segment; and the second wall is integral with the second edge segment.

13. In a V-blade plow with adjustable first and second plow blades, each having an inner end rotatably connected to a pivot frame and having a bottom edge, a cutting edge arrangement comprising:

a first edge segment removably attached to the first plow blade and projecting downward below the bottom edge of the first plow blade, wherein the first edge segment has a downwardly extending first edge adjacent the pivot frame;

a second edge segment removably attached to the second plow blade and projecting downward below the bottom edge of the second plow blade, wherein the first edge segment has a downwardly extending second edge adjacent the pivot frame; and a center edge segment attached directly to each of the first and second plow blades and having a first wall extending from the first edge segment, in alignment with the first edge, and second wall extending from the second edge segment, in alignment with the second edge, wherein the first wall and the second wall meet underneath the pivot frame at an angle beneath the pivot frame.

14. The cutting edge arrangement as recited in claim 13 wherein the first wall is integral with the first edge segment, and the second wall is integral with the second edge segment.

15. The cutting edge arrangement as recited in claim 13 wherein the first wall is detached from the first edge segment, and the second wall is detached from the second edge segment.

16. The cutting edge arrangement as recited in claim 15 wherein the first wall is integral with the second wall.

17. The cutting edge arrangement as recited in claim 15 wherein the first wall is detached from the second wall.

18. The cutting edge arrangement as recited in claim 13 wherein the first edge segment has a first side section projecting around an outer end of the first plow blade; and the second edge segment has a second side section projecting around an outer end of the second plow blade.

* * * * *